United States Patent [19]

Walker

[11] Patent Number: 4,979,301

[45] Date of Patent: Dec. 25, 1990

[54] LOCKING MECHANISM FOR FOLDING BLADE KNIFE

[76] Inventor: Michael L. Walker, P.O. Box 2343, Taos, N. Mex. 87571

[21] Appl. No.: 495,893

[22] Filed: Mar. 19, 1990

[51] Int. Cl.[5] ..... B26B 3/06; D06M 11/00; D06M 13/00

[52] U.S. Cl. ..... 30/161; 7/118; 7/120

[58] Field of Search ..... 30/160, 161, 349, 159, 30/158; 7/118, 119, 120

[56] References Cited

U.S. PATENT DOCUMENTS

| | | | |
|---|---|---|---|
| 996,235 | 6/1911 | Fuller | 30/161 |
| 1,627,689 | 5/1927 | Culver | 7/120 |
| 4,502,221 | 3/1985 | Pittman | 30/161 |
| 4,563,813 | 1/1986 | Fortenberry | 7/118 |
| 4,901,439 | 2/1990 | Boyd, Jr. | 30/161 |

*Primary Examiner*—Douglas D. Watts
*Assistant Examiner*—Paul M. Heyrana, Sr.
*Attorney, Agent, or Firm*—Charles C. Wells

[57] ABSTRACT

A folding blade knife constructed so that the knife blade can be opened or closed with one hand. The knife includes a handle composed of two side members that are assembled in a spaced relation to provide space for a blade. A blade is pivotally mounted in one end of the handle for movement to an open or closed position. The blade has an elongated slot cut therein and the slot is located in the end of the blade mounted in the handle. A locking lever is pivotally mounted in the elongated slot in the blade. The lever has a release button formed on one end and a locking button formed on the other end. A pair of locking recesses are formed in the interior surface of one of the handle sides members. These recesses are located adjacent to the end of the handle where the blade is mounted. The elongated slot in the blade, and thus the locking lever, are positioned so that the locking button of the locking lever will engage the locking recesses in the handle. The release button on the other end of the lever can be depressed manually to move the locking button out of the locking recesses. A portion of the elongated slot is a through slot that is enclosed in the handle and it receives the locking button portion of the locking lever. The remainder of the slot is a blind slot whose end is located outside the handle and it receives the release button of the locking lever. When the release button is pressed the lever is pivoted and the locking button is moved out of the locking recesses in the handle. A coil spring is positioned between the release button end of the lever and the bottom of the blind slot to bias the locking button of the lever into the locking recesses in the handle.

8 Claims, 1 Drawing Sheet

LOCKING MECHANISM FOR FOLDING BLADE KNIFE

BACKGROUND OF THE INVENTION

Field of the invention: This invention is in the field of folding blade knives and more particularly this invention relates to a blade locking mechanism for a knife that enables the knife to be opened or closed with one hand.

Description of the prior art: Knives are extensively used by ranchers, farmers, paramedics, sailors etc. to perform their many tasks and such persons usually carry a knife of some type with them. Folding blade knives are the easiest and most comfortable knife to carry but they have the disadvantage that normally two hands are needed to open the blade of a folding blade knife. These people are regularly faced with the need to open a folding knife with one hand while performing a task. Some folding blade knives can be closed using one hand but since the handle must be grasped in one hand and the blade moved with a finger of the same hand there is a danger of the hand being cut by a sharp blade. So far as known there are no folding blade knives, other than switch blades which are often illegal and lack the strength needed for a working knife, that are capable of being easily opened and closed with one hand.

SUMMARY OF THE INVENTION

A primary object of this invention is to provide a locking mechanism for a folding blade knife in which the blade is securely locked in an open or closed position, but the locking mechanism can be actuated to release the blade and the blade opened or closed while holding the knife in one hand.

Another object of the invention is to provide a folding blade knife which is thin and lightweight because the blade locking mechanism is built into the handle and blade without adding any components that add weight and thickness to the knife.

These and other objects of the invention are achieved by a knife having a folding blade with a locking lever pivotally mounted therein. The locking lever is positioned near the end of the blade that is pivotally mounted in the knife handle and the blade has an elongated slot cut therein in which the lever is mounted. The lever is sized to fit the elongated slot and the lever has a locking button formed on one end thereof and a release button on the other end. Locking recesses are cut in an interior surface of the knife handle and positioned so that the locking button on the lever engages the recesses when the blade is in an open or closed position. The handle includes two spaced apart side members and suitable hardware for assembling the side members and pivotally mounting the blade in the handle. The release button is located outside the knife handle so that it can be pressed to move the locking button out of the locking recesses in the handle. The locking lever is spring biased to a normally locked position.

DETAILED DESCRIPTION OF THE INVENTION

Figure 1:
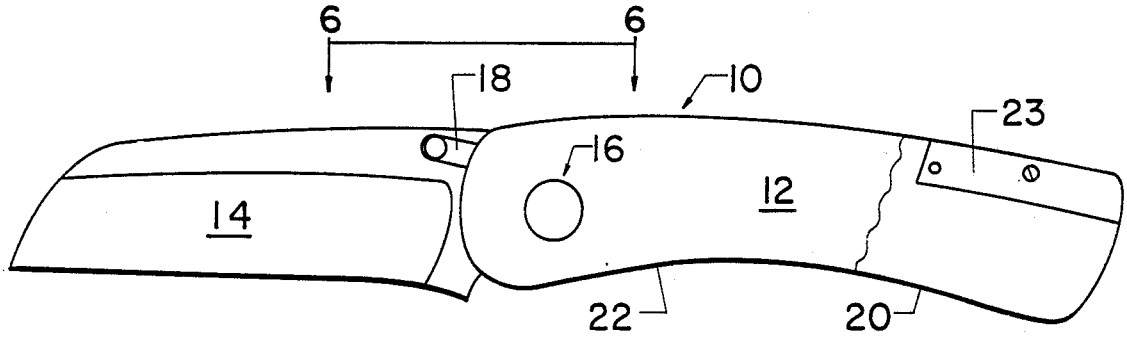
FIG. 1 is a side view of the invention with the knife blade in an open position which illustrates the position of the locking lever and release button in the knife blade
Figure 2:
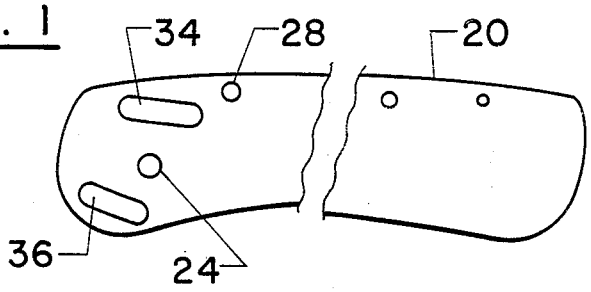
FIG. 2 is a side view of one of the knife handle side members showing the interior surface thereof and the location of the locking recesses. The side member shown is the side member 20 partiallY shown in FIG. 1.

FIG. 1 shows a knife 10 consisting of a handle 12 and a blade 14 pivotally mounted in the handle with a pivot bolt 16. The blade is locked in this position by a locking lever 18 that is pivotally mounted in the blade.

Handle 12 includes two side members 20 and 22 that are assembled in an aligned and spaced relationship so as to provide a space for the knife blade when the blade is in a closed position(not shown). The spacing of the side members is determined at the blade end by blade thickness and the thickness of suitable washers or shims 21, see FIG. 6. Handle thickness at the other end is determined by the thickness of a spacer 23 secured between the side members when the knife is assembled. The side members have holes 24 and 26 through which the pivot bolt 16 passes when the knife is assembled. The side members have blind holes 28 and 30 that open to the interior sides of the side members to accommodate a stop pin 32 installed when the knife is assembled. The stop pin functions to stop movement of the blade when the blade is being opened or closed.

Side member 20 has two locking recesses 34 and 36 cut in it's interior surface that are positioned around the pivot pin hole in the side member. These recesses receive locking lever 18 in a manner described hereafter to lock the blade in an open or closed position.

Figure 3:
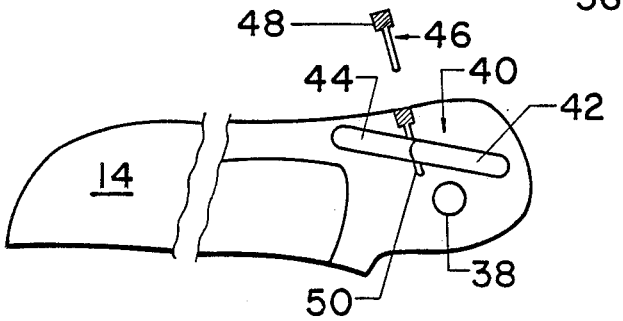
FIG. 3 is a side view of the blade removed from the knife and the locking lever is removed from the elongated slot in the blade.
Figure 4:
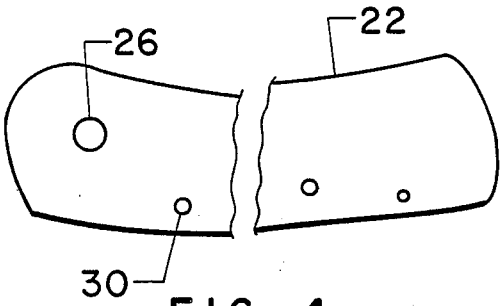
FIG. 4 is a side view illustrating the internal side of the side member 22 shown in FIG. 1.

Blade 14, as shown in FIG. 3, has a pivot pin hole 38 in one end thereof and closely adjacent thereto an elongated slot 40 is cut in the blade. One end of the slot is cut completely through the blade to form a through slot 42. The other end of the slot is cut only partially through so as to form a blind slot 44. A pivot pin 46 having an upper threaded section 48 is threaded into a partially threaded hole 50 in the blade. The pivot pin secures locking lever 18 in the elongated slot in the blade.

Figure 5:
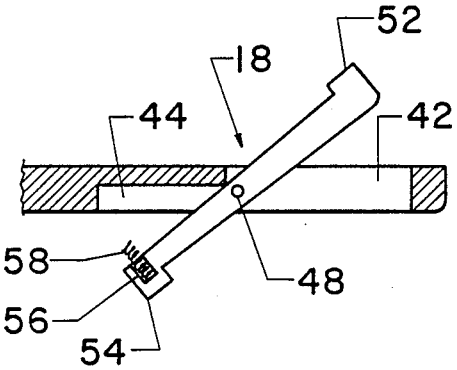
FIG. 5 is a top, broken away, view of the blade shown in FIG. 3, that shows the locking lever mounted in the blade.

Locking lever 18, see FIG. 5, has a locking button formed on one end thereof and a release button 54 formed on the other end.

A recess 56 that receives a coil spring 58 is cut in the release button end of the locking lever. Coil spring 58 engages the bottom of blind slot 44 and biases the locking lever in a counter clockwise direction cause locking button 52 to enter locking recesses 34 and 36 to lock the blade in an open or closed position. When the blade is closed the locking button enters recess 36 and when the blade is open the locking button is in recess 34.

Figure 6:
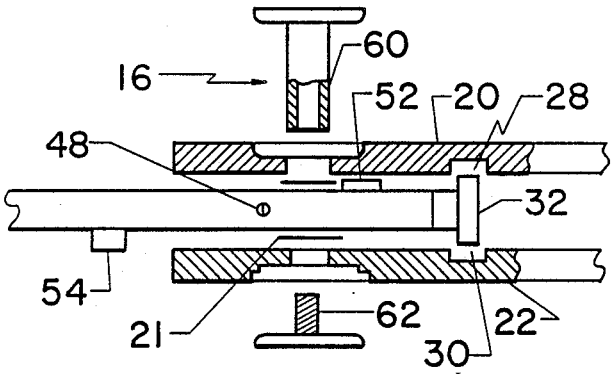
FIG. 6 is a view, partially in section, taken along lines 6—6 in FIG. 1, that illustrates the pivotal mounting of the blade and the position of the blade stop pin.

The blade is mounted in the handle by pivot bolt 16 which consists of an internally threaded nut section 60 and an externally threaded bolt section 62, see FIG. 6. Washers or shims 21 are mounted on the pivot bolt between the blade and the side members to facilitate the pivotal movement of the blade in the handle.

When the knife is assembled the locking lever is retained in the blade by the close fit between the blade and the handle. However, due to the shape of the locking lever the locking button formed thereon will be moved into the locking recesses by counterclockwise pivotal movement of the lever about pin 46 due to the action of spring 58. When pressure is applied to release button 54 it bottoms out in slot 44 resulting in clockwise motion of the lever and withdrawal of the locking button from the locking recesses to permit pivotal motion of the blade relative to the handle.

The knife can be opened with one hand by pressing the release button with the thumb of the hand holding the knife and then rotating the blade with thumb pressure to an open position. Thumb pressure is released as the blade approaches an open position. Alternatively the blade can be opened by grasping the edge of the closed blade with the tips of the fingers and thumb, pressing the release button with the tip of the forefinger and then rotating the handle to an open position. Either of these opening procedures can be reversed to close the knife.

This completes the description of a preferred embodiment of the invention. However it will be apparent to those skilled in the art that some changes and modifications can be made to the invention without departing from the spirit and scope of the claims as defined in the claims appended hereto.

What is claimed is:

1. A folding blade knife constructed for opening and closing with one hand comprising:

an elongated handle means that includes two side members assembled in an aligned end spaced relationship to provide a space for a knife blade between the interior surfaces of said side members;

recess means formed in the interior surface of one of said side members;

blade means having one of its ends pivotally mounted in one end of said handle means for movement between an open extended position and a closed position wherein said blade means is folded into the space between the side members of said elongated handle means;

manually releaseable locking means mounted in said blade means and positioned so as to be partially within the handle and partially out of the handle; and spring means mounted between said locking means and said blade means for moving said locking means into said recess means formed in the interior surface of one of said side members to lock the blade in a open or closed position except when said locking means is manually depressed to release the blade for pivotal movement to an open or closed position.

2. The folding blade knife recited in claim 1 which further comprises:

an elongated slot means formed in said blade means in the end thereof that is pivotally mounted in said handle means; and said manually releaseable locking means includes a locking lever mounted in said elongated slot means and biased by said spring means to a locking position whereby said locking lever, except when manually released, enters into said recess means in one of said side members to lock the blade means in an open or closed position.

3. The folding knife recited in claim 2 wherein: said elongated slot means is cut completely through said blade at one end thereof to form a through ,slot positioned in and hidden by the handle means, and the elongated slot means is cut only partially through said blade means at the other end thereof to form a blind slot positioned so as to be at least partially exposed outside the handle means;

said locking means includes pin means mounted in said blade means for pivotally mounting said locking lever in the elongated slot means of said blade means;

a locking button is formed on one end of said locking lever, a release button on the other end of said locking lever and a through hole is formed in said locking lever intermediate the ends thereof to receive said pin means for pivotally mounting said locking lever;

said locking lever being mounted in said elongated slot means so that the release button, end thereof is positioned in the blind slot; and said spring means is positioned between the release button end of the locking lever and the bottom of the blind slot in the blade means so as to bias said locking lever in a locking direction.

4. The folding knife recited in claim 3 which further includes a stop pin mounted in said handle means and positioned near the blade mounting end of said handle so as to engage said blade means when said blade means is in its open or closed position, whereby rotation of the blade means past its open or closed position when the locking lever is in a released position is prevented.

5. The folding knife recited in claim 4 wherein:

a blind hole is in the release button end of said locking lever, said blind hole opening toward the bottom of the blind slot when the locking lever is pivotally mounted in the elongated slot in said blade means; and said spring means is a coil spring having one of its ends mounted in the blind hole in the release button end of said locking lever, whereby the other end of said coil spring engages the bottom of the blind slot.

6. A folding blade knife constructed for opening and closing with one hand comprising:

a handle means that includes a first side member and a second side member, said side members being assembled in an aligned and spaced relation to provide a space for a knife blade between the interior surfaces of the assembled side members;

a first locking recess in the interior surface of said first side member, said first recess being located in the blade mounting end of said handle means;

a second locking recess in the interior surface of said first side member, said second recess being located in the blade mounting end of said handle and spaced from said first recess;

blade means pivotally mounted in the blade mounting end of said handle means for movement between an open and closed position;

a finger operated locking means pivotally mounted in said blade means, said locking means being partially positioned within said handle means for selectively engaging said first and second locking recesses to lock said blade means in an open or closed position;

said locking means being partially positioned outside of said handle means whereby said locking means can be finger actuated to unlatch said locking means from said recesses and permit rotation of said blade means to an open or closed position; and spring means mounted between said locking means and said blade means for moving said locking means into said first and second locking recesses.

7. The folding blade knife recited in claim 6 wherein:

said blade means has an elongated slot therein for mounting said locking means that is located in the end of the blade that is mounted in said handle means, a portion of said slot being cut completely through the blade means to form a through slot and the remaining portion of said slot being cut only part way through said blade means to form a blind slot;

said locking means includes pin means mounted in said blade means and positioned so as to pass through said elongated slot and provide a pivot pin for said locking means mounted in said blade means; and said locking means is a locking lever having a locking button on one end thereof for positioning in the through slot, a release button on the other end thereof that is positioned in the blind slot, and a through hole positioned between the locking and release buttons so that the locking lever can be pivotally mounted in the elongated slot, whereby said locking button can be moved into said first and second locking recesses to lock said blade means in an open or closed position.

8. The folding blade knife recited in claim 7 wherein:

a blind hole is in the release button end of said locking lever, said blind hole opening toward the bottom of the blind slot when the locking lever is pivotally mounted in the elongated slot in said blade means; and said spring means is a coil spring having one of its ends mounted in the blind hole in the release button end of said locking lever, whereby the other end of said coil spring engages the bottom of the blind slot.

* * * * *